US005306010A

United States Patent [19]

Choi

[11] Patent Number: 5,306,010

[45] Date of Patent: Apr. 26, 1994

[54] EXTENSIBLE EXERCISE GOLF CLUB

[76] Inventor: Richard W. Choi, 111 S. Poinsettia Pl., Los Angeles, Calif. 90036

[21] Appl. No.: 57,838

[22] Filed: May 7, 1993

[51] Int. Cl.[5] ..... A63B 69/36

[52] U.S. Cl. ..... 273/186.2; 273/81.2

[58] Field of Search ..... 273/186.2, 80.1, 187.3, 273/193 R, 194 R, 193 B, 81.2, 80 D

[56] References Cited

U.S. PATENT DOCUMENTS 3,837,689 9/1974 Csatlos ..... 273/81.2 X 4,674,747 6/1987 Mazzocco ..... 273/81.2

4,932,661 6/1990 Choi ..... 273/186.2

*Primary Examiner*—George J. Marlo

*Attorney, Agent, or Firm*—Birch, Stewart, Kolasch & Birch

[57] ABSTRACT

An extensible exercise golf club including a golf club shaft comprising a plurality of telescopic interlocking shaft lengths which function to extend from a collapsed position to a fully extended position as a result of the force generated by the swinging action of the golf club and automatically return to the collapsed position by the force of vacuum generated within the shaft as the shaft sections are telescopically extended.

6 Claims, 2 Drawing Sheets

EXTENSIBLE EXERCISE GOLF CLUB

BACKGROUND OF THE INVENTION

1. Field of the Invention

The present invention relates to an extensible exercise golf club for training golfers and more particularly, to an exercise golf club which includes a plurality of telescopic interlocking tubular shaft lengths containing a vacuum space disposed therein for causing the telescoped shaft lengths to extend from a collapsed position to a fully extended position and then to collapse from the extended position to a fully collapsed position as a result of the force generated by the vacuum space. Thus, beginning golfers can learn to swing a golf club very easily with very little effort, thus effectively reducing the training period.

2. Description of the Prior Art

Several types of collapsible golf clubs are known in the art. For example, such golf clubs include those which possess adjustable shaft lengths; means for varying the grip of golf clubs axially collapsible shafts, and the like. However, such collapsible golf clubs suffer from many problems. For example, it is difficult for a beginning golfer to timely hit a golf ball using such golf clubs and to properly control the power transferred from the legs of the golfer to a golf club head. Such golf clubs are described in U.S. Pat. No. 2,107,983 to Hamilton, U.S. Pat. No. 2,214,079 to Horton, U.S. Pat. No. 2,772,887 to Blake, U.S. Pat. No. 3,070,370 to Steiner, U.S. Pat. No. 3,102,726 to Barrett, U.S. Pat. No. 3,214,170 to Warnock, U.S. Pat. No. 3,524,646 to Wheeler, U.S. Pat. No. 3,528,660 to Kategian, U.S. Pat. No. 3,539,185 to Andis, U.S. Pat. No. 3,663,019 to Palotsee, U.S. Pat. No. 3,829,092 to Arkin, U.S. Pat. No. 3,840,231 to Moore, U.S. Pat. No. 4,343,473 to Laursen, U.S. Pat. No. 4,674,747 to Mazzocco et al.

In order to avoid such problems, U.S. Pat. No. 4,931,661, issued to the present inventor, describes an extensible exercise golf club including a golf club shaft comprising a plurality of telescopic tubular members which telescopically fit into each other for slidably extending from a telescopically collapsed position to a telescopically extended position. Channel and rail members are disposed alternately on the inner and outer surfaces of adjacent telescopic tubular members, whereby the rail member of one tubular member engages the channel member of an adjacent tubular member for interlocking the adjacent telescopic tubular members together. Thus, upon swinging the golf club, the club shaft member of the golf club is guided by the engagement of the rail members within the channel members whereby the twisting of adjacent shaft members is effectively prevented.

However, this extensible exercise golf club is complicated in structure and expensive to manufacture. Furthermore, in order to collapse the extended telescopic tubular shaft members, the golfer has to utilize force to push the tubular shaft members, which takes time in its operation. Sometimes, if the channel and rail members become broken, the extensible exercise golf club cannot be used and thus it becomes uneconomical.

SUMMARY OF THE INVENTION

Accordingly, it is an object of the present invention to provide an improved extensible exercise golf club for use in training golfers.

Another object of the present invention is to provide an extensible exercise golf club which includes a plurality of concentric, telescopic interlocking tubular light shaft lengths containing a vacuum space disposed therein which extends from the handle member.

A further object of the present invention is to provide an extensible golf club which is further provided with a pseudo-ball containing a weight member disposed therein and attached to the heel shaft thereof, whereby the golfer can swing freely.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to an extensible golf club including a golf club shaft which comprises a plurality of telescopic interlocking shaft lengths and a vacuum space disposed therein, and a golf ball containing a weight member attached to the end of the shaft whereby the shaft extends from a collapsed position to a fully extended position as a result of the force generated by the swinging action of the golf club. The shaft then collapses from an extended position to a fully collapsed position as a result of the vacuum force generated in the vacuum space by the extension of the shaft members.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
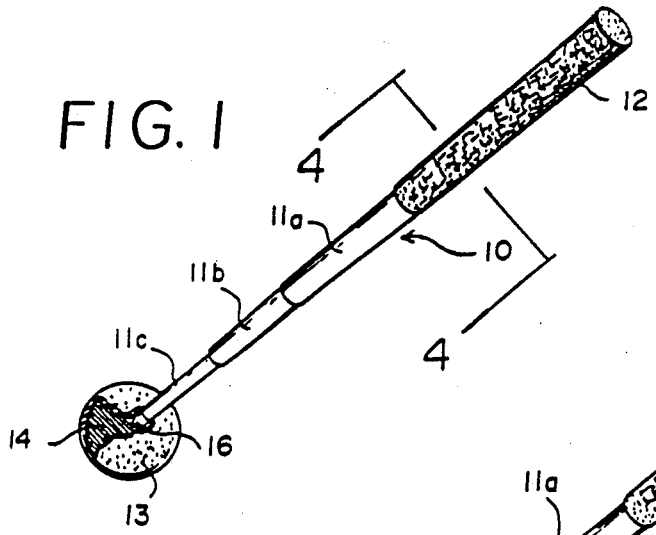
FIG. 1 is a perspective view of an extensible golf club according to the present invention in a fully collapsed position, showing in cut away portions thereof the basic components of the present invention.
Figure 2:
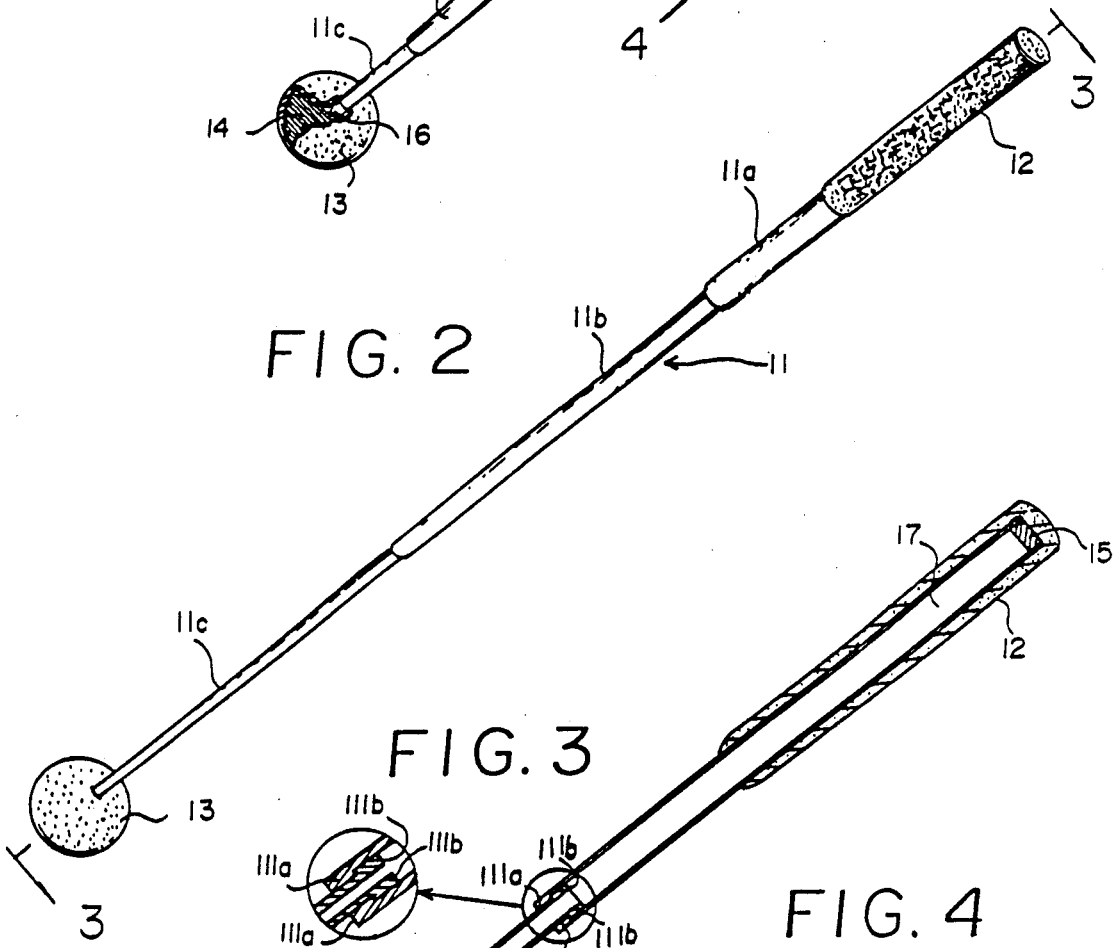
FIG. 2 is a perspective view of the extensible club according to the present invention in a fully extended position.
Figure 3:
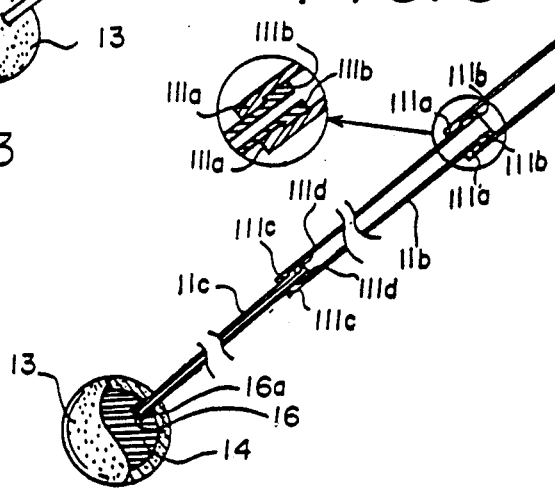
FIG. 3 is a sectional view of FIG. 2, taken along line 3—3, showing the enlarged connecting portions of a tubular shaft length.

Referring now in detail to the drawings for the purpose of illustrating preferred embodiments of the present invention, the extensible exercise golf club as shown in FIGS. 1, 2, and 3 comprises an extensible shaft 10 defining a plurality of concentric, telescopically interlocking tubular shaft lengths 11*a*, 11*b*, and 11*c*, a pseudo-golf ball 13 containing a ball weight member 14 disposed at one end of the shaft and a cap 15 disposed at the other end of the extensible shaft 10. That is, the pseudo-golf ball 13 is provided at the end portion of the tubular shaft length 11*c* and the cap 15 is provided at the top of the tubular shaft length 11*a*, with the shafts defining a space 17 disposed in the tubular shaft lengths 11*a*, 11*b*, and 11*c*.

The tubular shaft length 11*a* is provided with a typical golf club grip member 12 disposed therearound for permitting a tight grasp of the golf club. The ball weight member 14 has an aperture 16 to facilitate its attaching to the end portion of the tubular shaft length 11*c* with a strong adhesive 16*a* as shown in FIG. 3. The ball weight member 14 is made of steel, rubber, or the like to add weight to the pseudo-golf ball 13.

As shown in FIG. 3, the telescopic interlocking tubular shaft lengths 11*a*, 11*b*, and 11*c* contain extended raised portions 111*a*, 111*b*, 111*c*, and 111*d* which operatively interlock with each other at the end openings of the shaft lengths.

Figure 4:
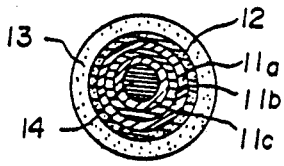
FIG. 4 is a cross-sectional view of FIG. 1, taken along line 4—4.

Accordingly, when the telescopic interlocking tubular shaft lengths 11*a*, 11*b*, and 11*c* are fully extended by the force of the swing of the player, the extended raised portions 111*a* and 111*b*, and 111*c* and 111*d* are tightly interlocked. At this time, a vacuum is generated in the space 17 of the telescopic interlocking tubular shaft lengths 11*a*, 11*b*, and 11*c* (FIGS. 2 and 3). Accordingly, when the swing of the golfer is finished, the fully extended tubular shaft lengths 11*a*, 11*b*, and 11*c* are caused to immediately collapse by the vacuum generated in the space 17 of tubular shaft lengths 11*a*, 11*b*, and 11*c* (FIGS. 1 and 4).

In assembly, first of all, the shaft length 11*c* is slidably inserted into the shaft length 11*b* so that the raised portion 111*c* of the shaft length 11*c* interlocks with the raised portion 111*d* of the shaft length 11*b*. Thus, the shaft length 11*b* is engaged with the shaft length 11*c* (FIG. 3). Thereafter, the shaft length 11*b* which is engaged with the shaft length 11*c* is slidably inserted into the shaft length 11*a* so that the raised portion 111*b* of the shaft length 11*b* interlocks with the raised portion 111*a* of the shaft length 11*a*. Thus, the shaft length 11*a* is engaged with the shaft length 11*b* (FIG. 3).

Afterwards, the cap 15 is placed on the end opening of the shaft length ll*a* and the grip member 12 is provided around the upper portion of the shaft length 11*a* (FIG. 3). Thereafter, the pseudo-golf ball 13 containing the weight member 14 is attached to the lower end portion of the shaft length 11*c* by inserting the shaft member into the aperture 16 of the ball 13 with the strong adhesive 16*a* (FIGS. 1 and 3). The weight member 14 is steel, rubber, or the like.

Figure 5:
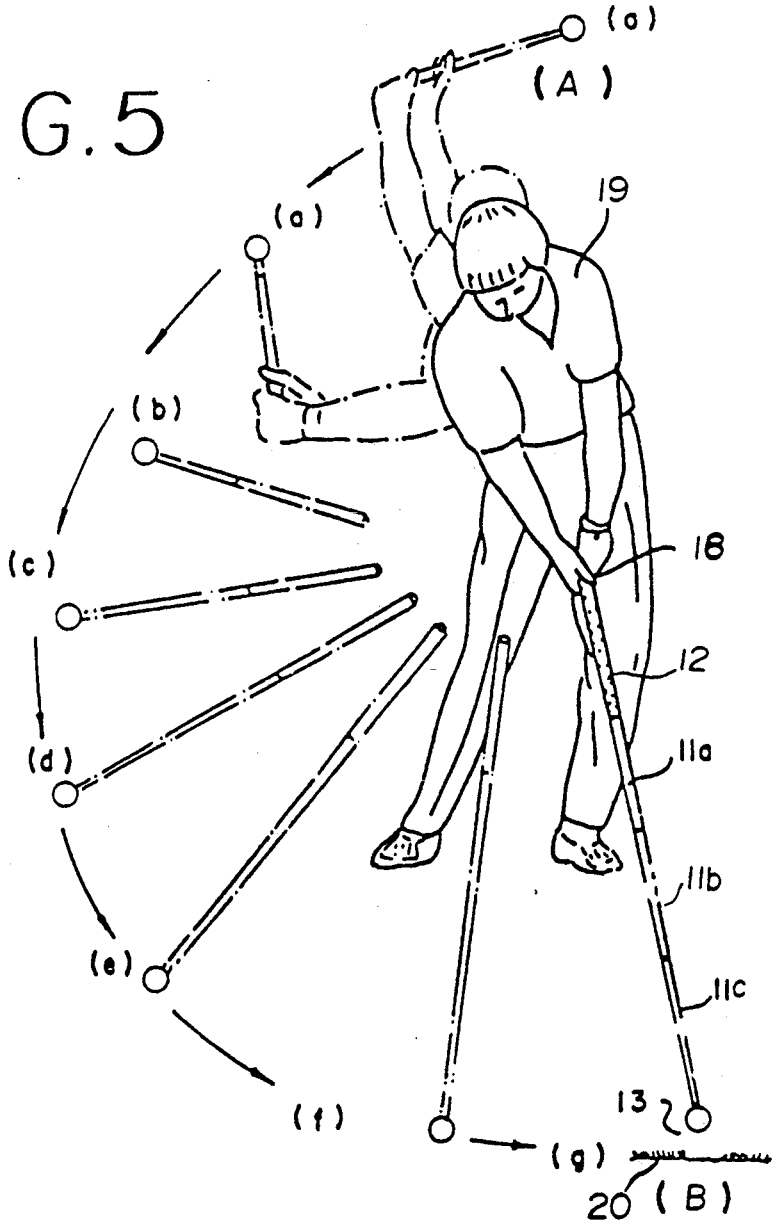
FIG. 5 is a pictorial view, showing a golfer using the extensible golf club according to the present invention.

In operation, as shown in FIG. 5, when a golfer swings forward, the golf club is gradually extended in the direction indicated by arrows (a), (b), (c), (d), (e), (f), and (g) from a collapsed position (A) to the extended position (B). At that time, the pseudo-golf ball 13 rhythmically hits a point disposed on the ground 20 and the golfer can swing with very little effort being required by the golfer.

Accordingly, the extensible shaft lengths 11*a*, 11*b*, and 11*c* of the exercise golf club are slidably and frictionally engaged with each other so that the force of the swing overcomes the frictional engagement for freely extending the club shaft during the swinging operation of the golf club for striking the ground 20.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. An extensible exercise golf club comprising:

a club head member, a club handle member, and a club shaft member disposed therebetween, said club shaft member including:

a plurality of telescopic tubular members which telescopically fit into each other for slidably extending from a telescopically collapsed position to a telescopically extended position, said telescopic tubular members, when in the extended position, defining an internal space, extended raised portions disposed on the outer and inner end portions of adjacent telescopic tubular members for slidably interlocking said adjacent telescopic tubular members together, and a cap for covering the end opening of the largest of said plurality of telescopic tubular members; and a weighted member attached to the end portion of the smallest one of said plurality of telescopic tubular members; and said club further including means whereby upon swinging the golf club, the club shaft member of the golf club is telescopically extended while simultaneously creating a vacuum within the internal space of the club shaft, and upon finishing the swing, the club shaft member of the golf club is automatically collapsed by the force of the vacuum generated in said internal space of the club shaft.

2. The extensible exercise golf club of claim 1, wherein said plurality of telescopic tubular members are at least two in number.

3. The extensible exercise golf club of claim 1, wherein said weighted member is a pseudo-golf ball having an aperture for tightly receiving said smallest one of said plurality of club shaft members.

4. The extended exercise golf club of claim 3, wherein an adhesive is utilized to attached the weighted member to the club shaft member.

5. The extensible exercise golf club of claim 1, wherein said weighted member is steel.

6. The extensible exercise golf club of claim 1, wherein said weighted member is rubber.

* * * * *